United States Patent [19]

Fritzenwenger

[11] 4,436,067

[45] Mar. 13, 1984

[54] ENGINE DRIVEN PUMP ARRANGEMENT

[75] Inventor: Josef Fritzenwenger, Anzing, Fed. Rep. of Germany

[73] Assignee: Bayerische Motoren Werke Aktiengesellschaft, Fed. Rep. of Germany

[21] Appl. No.: 324,580

[22] Filed: Nov. 24, 1981

[30] Foreign Application Priority Data

Nov. 25, 1980 [DE] Fed. Rep. of Germany ..... 3044253

[51] Int. Cl.³ ..... F01P 5/12; F01M 11/00

[52] U.S. Cl. ..... 123/198 C; 123/41.44; 123/195 A; 123/196 R

[58] Field of Search ..... 123/198 C, 195 A, 41.44, 123/41.45, 41.47, 196 R, 196 CP

[56] References Cited

U.S. PATENT DOCUMENTS

| | | | |
|---|---|---|---|
| 4,114,586 | 9/1978 | Fujikawa et al. | 123/198 C |
| 4,198,935 | 4/1980 | Seibt et al. | 123/198 C |
| 4,295,807 | 10/1981 | Krüger | 123/198 C |
| 4,334,508 | 6/1982 | Sasaki | 123/198 C |

FOREIGN PATENT DOCUMENTS

| | | | |
|---|---|---|---|
| 979766 | 12/1975 | Canada | 123/198 C |

*Primary Examiner*—Ira S. Lazarus
*Attorney, Agent, or Firm*—Craig & Burns

[57] ABSTRACT

An internal combustion engine includes a drive connection for auxiliary equipment. The equipment includes a step-down gear and a pump impeller of a coolant pump and a pump wheel of a lubricating oil gear pump situated on a common shaft. The drive connection of the engine is characterized in that pump wheels of the lubricating oil gear pump form the step-down gear for the coolant pump.

11 Claims, 1 Drawing Figure

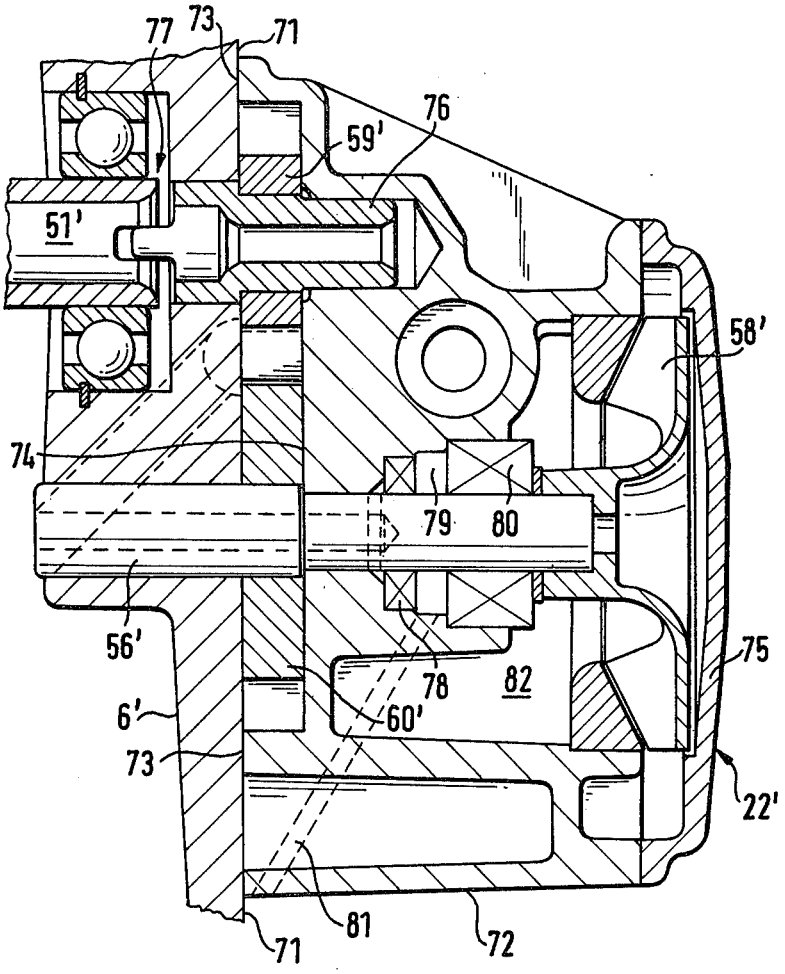
77
73
71
76
59'
51'
58'
74
79
80
56'
75
78
82
6'
60'
73
22'
81
71
72

ENGINE DRIVEN PUMP ARRANGEMENT

BACKGROUND OF THE INVENTION

The present invention pertains to an internal combustion engine comprising a drive connection for auxiliary equipment including a step-down gear and wherein a pump impeller of a coolant pump and a pump wheel of a lubricating oil gear pump are situated on a common shaft.

An internal combustion engine of this type is disclosed in German Offenlegungsschrift No. 29 22 695. In such an internal combustion engine the lubricating oil gear pump is driven via a step-down gear of a secondary drive shaft which rotates at the crankshaft rpm. The larger gear wheel of the step-down gear is located on the common shaft of the pumps which supports the driving pump wheel of the lubricating oil gear pump and the impeller of the coolant pump. The step-down gear requires friction and takes up space in the housing of the internal combustion engine, as well as increasing the manufacturing cost. Because of the pump's power behavior, the coolant pump is operated in most cases at a lower rpm than the crankshaft.

SUMMARY AND OBJECTS OF THE INVENTION

An object of the present invention is to provide an internal combustion engine comprising a drive connection of the aforementioned type with an auxiliary piece of equipment wherein the drive connection for a lubricating oil gear pump and the coolant pump is compact, simple and inexpensive, while retaining a gear reduction for the coolant pump.

This and other objects of the invention are attained by providing an internal combustion engine comprising a drive connection with auxiliary equipment which includes a step-down gear and wherein a pump impeller of a coolant pump and a pump wheel of a lubricating oil gear pump are situated on a common shaft with the pump wheels of the lubricating oil gear pump forming the step-down gear for the coolant pump. The design in accordance with the invention ensures a very compact drive connection for the lubricating oil gear pump and the coolant pump.

According to a disclosed preferred embodiment of the invention, the drive connection further comprises a secondary drive shaft driven by the crankshaft of the engine, and wherein the pump wheels forming the step-down gear include a drive pump wheel of the lubricating oil gear pump which is situated coaxially to the secondary drive shaft and is connected to the secondary drive shaft by male coupling means. Such an arrangement provides for the formation of a pump unit which can be preassembled and which can easily be attached to and detached from the housing of an internal combustion engine.

In this disclosed embodiment the invention is further characterized in that the lubricating oil gear pump and the coolant pump are located in a common pump housing at a face of a housing of the internal combustion engine, and in that the pump wheels of the lubricating oil gear pump are recessed in the pump housing such that the faces of the pump wheels face towards the housing of the internal combustion engine. A mounting pad of the pump housing and a flange facing of the engine housing lie in the same plane. This simplifies the arrangement of the flange facings at the housing of the internal combustion engine and pump housing.

An additional feature of the disclosed embodiment of the invention is that an inlet chamber of the coolant pump is situated in the pump housing between the lubricating oil gear pump and the impeller of the coolant pump. This takes advantage of the construction space acquired by the axial room needed by the coolant pump seal to ensure a compact arrangement of the inlet chamber of the coolant pump.

These and other objects, features, and advantages of the present invention will become more apparent from the following description when taken in connection with the accompanying drawing which shows, for the purposes of illustration only, one embodiment of the invention.

BRIEF DESCRIPTION OF THE DRAWINGS

The drawing shows a vertical longitudinal section of a lubricating oil gear pump and a coolant pump, including its drive connection to a secondary shaft of an internal combustion engine according to one embodiment of the invention.

DETAILED DESCRIPTION OF THE PREFERRED EMBODIMENT

A pump housing 72 with its mounting pad 73 is attached to a flange facing 71 of a housing part 6' of an internal combustion engine, the rest of which is not shown. In its section facing housing part 6', pump housing 72 has pump wheels 59' and 60' of a lubricating oil gear pump in a recess 74, and in the section opposite that it has a coolant pump 22' with an impeller 58'. Housing cover 75 forms the closure housing 72. Drive pump wheel 59' of the lubricating oil gear pump features a smaller number of teeth than does driven pump wheel 60'. Thus pump wheels 59' and 60' form a step-down gear for coolant pump 22'. The drive pump wheel 59' is secured on a shaft 76 mounted in pump housing 72 in such a way as to resist torsion. Shaft 76 is arranged coaxially with a secondary drive shaft 51' of the internal combustion engine and is connected to secondary drive shaft 51' by means of a male coupling 77.

As illustrated in the single drawing FIGURE, the pump wheels 59' and 60' of the lubricating oil gear pump are recessed in the recess 74 of the pump housing 72 such that the faces of the pump wheels face towards the housing part 6' of the internal combustion engine. The mounting pad 73 of the pump housing and the flange facing 71 of the engine housing lie in the same plane. This simplifies the arrangement of the flange facings at the housing of the internal combustion engine and pump housing.

An inlet chamber 82 of the coolant pump 22' is situated in the pump housing 72 between the lubricating oil gear pump, particularly the pump wheels 59' and 60' thereof, and the impeller 58' of the coolant pump. This takes advantage of the construction space acquired by the axial room needed by the coolant pump seal to ensure a compact arrangement of the inlet chamber of the coolant pump.

The driven pump wheel 60' of the lubricating oil gear pump and the impeller 58' of the coolant pump 22' are mounted on a common pump shaft 56'. The pump shaft 56' is journalled in the pump housing 72 and in the housing part 6'. A first sealing 78, a ring chamber 79 and a second sealing 80 are arranged between the pump wheel 60' and the impeller 58'. A channel 81 leads from the ring chamber 79 to the atmosphere. A substantially annular inlet chamber 82 of the coolant pump 22' is arranged at a distance around the sealings 78 and 80 and the ring chamber 79, whereby the axial dimension of the inlet chamber 82 decreases helically.

In consequence to the coaxial arrangement of the driven pump wheel 59' and the secondary drive shaft 51' and owing to the drive connection to the secondary drive shaft 51' which is formed as a male coupling 77, the lubricating oil gear pump and the cooling pump 22' can be preassembled as a common pump unit. In this way the assembling with the housing part 6' is simplified. The arrangement of the pump wheels 59' and 60' of the lubricating oil gear pump in a recess 74 of the pump housing 72 simplifies machining of the flange facing of the housing part 60' and of the mounting pad 73 of the pump housing 72. The inlet chamber 82 of the cooling pump 22' is situated space savingly between the pump wheel 60' of the lubricating oil gear pump and the impeller 58' of the cooling pump 22'. This takes advantage of the radially outer part of the interspace between the pump wheel 68 and the impeller 58' which has to be provided for the sealings 78 and 80 and the ring chamber 79. The compact structure of the internal combustion engine is very much improved by means of this compact arrangement of the pump unit consisting of the lubricating oil gear pump and the coolant pump 22' and by using the pump wheels 59' and 60' of the lubricating oil gear pump as a step-down gear.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. An internal combustion engine comprising a drive connection for a pump assembly wherein the assembly includes a step-down gear, a pump impeller of a coolant pump and a pump wheel of a lubricating oil gear pump situated on a common shaft, wherein pump wheels of the lubricating oil gear pump form the step-down gear for the coolant pump.

2. An internal combustion engine according to claim 1, wherein the drive connection further comprises a secondary drive shaft driven by the crankshaft of the engine, wherein the pump wheels forming said step-down gear include a drive pump wheel of the lubricating oil gear pump which is situated coaxially relative to said secondary drive shaft and is connected to said secondary drive shaft by male coupling means.

3. An internal combustion engine according to claim 1 or 2, wherein the lubricating oil gear pump and the coolant pump are located in a common pump housing at a face of a housing of the internal combustion engine, and the pump wheels of the lubricating oil gear pump are recessed in said pump housing such that the faces of the pump wheels face towards the housing of the internal combustion engine, a mounting pad of the pump housing and a flange facing of said engine housing lie in the same plane.

4. An internal combustion engine according to claim 3, including an inlet chamber of the coolant pump situated in the pump housing between the lubricating oil gear pump and the impeller of the coolant pump.

5. A pump arrangement for an internal combustion engine comprising a lubricating oil pump having a plurality of pump wheels and a coolant pump having an impeller, one wheel of said plurality is aligned with and driven by a drive associated with said engine, another wheel of said plurality and said impeller are mounted on a common shaft, said plurality of wheels forming a step-down gear arrangement for driving said impeller.

6. A pump arrangement as set forth in claim 5, wherein said one wheel is driven by said drive through a drive connection, said drive connection including a secondary drive shaft driven by the crankshaft of the engine and a releasable coupling menas for transmitting the driving force of the secondary drive shaft to said one wheel.

7. A pump arrangement as set forth in claim 5, wherein said lubricating pump and said coolant pump are located in a common pump housing.

8. A pump arrangement as set forth in claim 7, wherein said plurality of pump wheels are recessed in a face of said housing which faces said engine.

9. A pump arrangement as set forth in claim 7, including an inlet chamber for the coolant pump situated in the pump housing between the lubricating oil pump and the impeller of the coolant pump.

10. A pump arrangement as set forth in claim 6, wherein said lubricating pump and said coolant pump are located in a common pump housing.

11. A pump arrangement as set forth in claim 10, wherein said lubricating oil pump, said coolant pump, and said housing form an assembly which is separable from said engine as a unit.

* * * * *